US007632359B2

(12) United States Patent
Sakurai et al.

(10) Patent No.: US 7,632,359 B2
(45) Date of Patent: Dec. 15, 2009

(54) CLEANING LIQUID AND NOZZLE PLATE CLEANING METHOD

(75) Inventors: Naoaki Sakurai, Yokohama (JP); Junsei Yamabe, Yokohama (JP)

(73) Assignee: Kabuhsiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/856,364

(22) Filed: Sep. 17, 2007

(65) Prior Publication Data

US 2008/0207478 A1 Aug. 28, 2008

(30) Foreign Application Priority Data

Sep. 21, 2006 (JP) ..... 2006-255512

(51) Int. Cl.
*B08B 3/00* (2006.01)

(52) U.S. Cl. ..... 134/26; 134/29

(58) Field of Classification Search ..... None
See application file for complete search history.

(56) References Cited

U.S. PATENT DOCUMENTS 5,888,308 A 3/1999 Sachdev et al.
6,517,188 B1 * 2/2003 Hawkins et al. ..... 347/34
6,596,677 B1 * 7/2003 Machac et al. ..... 510/238
6,648,464 B1 * 11/2003 Parazak ..... 347/100
2004/0001116 A1 * 1/2004 Wouters et al. ..... 347/28
2005/0116978 A1 * 6/2005 Kubota ..... 347/19

FOREIGN PATENT DOCUMENTS

JP 10-264362 10/1998
JP 2005-145054 6/2005
WO WO 89/07130 8/1989

* cited by examiner

*Primary Examiner*—Michael Kornakov
*Assistant Examiner*—Eric Golightly
(74) *Attorney, Agent, or Firm*—Oblon, Spivak, McClelland, Maier & Neustadt, L.L.P.

(57) ABSTRACT

A weakly alkali cleaning liquid suitable for use in the case of cleaning and removing inks adhered to a nozzle plate, in an ink jet printer using inks in which inorganic pigments and metal oxides are mixed into polymers, is provided. In the cleaning liquid, carbonates are added to the weakly alkali solution of pH 8 to pH 12.

10 Claims, 3 Drawing Sheets

CLEANING LIQUID AND NOZZLE PLATE CLEANING METHOD

CROSS-REFERENCE TO RELATED APPLICATION AND INCORPORATION BY REFERENCE

This application claims benefit of priority under 35 USC 119 based on Japanese Patent Application P2006-255512, filed Sep. 21, 2006, the entire contents of which are incorporated by reference herein.

BACKGROUND OF THE INVENTION

1. Field of the Invention

The present invention relates to a cleaning liquid and a nozzle plate cleaning method, and more particularly, to a cleaning method of cleaning a nozzle plate of an ink jet head and a cleaning liquid suitable for this cleaning of a nozzle plate.

2. Description of the Related Art

As described in Japanese Patent Application Laid Open No. 2005-145054, on an ink jet head of an ink jet printer, a nozzle plate on which a plurality of nozzles are formed is provided. In such an ink jet printer, the printing is carried out by adhering ink drops injected from nozzles of the nozzle plate onto a recording medium. When the ink drops are injected from the nozzles, a part of the inks will be adhered to a surface of the nozzle plate, so that there is a need to clean the surface of the nozzle plate regularly in order to remove the adhered inks.

In the ink jet printer described in Japanese Patent Application Laid Open No. 2005-145054, a wiping member is set in contact with the surface of the nozzle plate and the adhered inks are wiped off by moving this wiping member along the surface of the nozzle plate.

The ink jet printer described in Japanese Patent Application Laid Open No. 2005-145054 is a device for consumer use, which mainly uses papers as the recording medium. For this reason, the inks to be used are formed by components such that the permeability with respect to papers is given a high importance and they can be wiped off easily when they are adhered to metals or resins constituting the nozzle plate. Consequently, as described in Japanese Patent Application Laid Open No. 2005-145054, the adhered inks can be wiped off by moving the wiping member in contact with the surface of the nozzle plate, along the surface of the nozzle plate.

However, in the nozzle plate cleaning method described in Japanese Patent Application Laid Open No. 2005-145054, the following points are not taken into consideration.

In the ink jet printer for industrial use, glasses or resins will be used as the recording medium, and the inks to be used have the good adhesive property with respect to glasses and resins. For example, the inks in which inorganic pigments or metal oxides are mixed into polymers will be used. For this reason, there has been a problem that it is difficult to remove such inks when they are adhered to the nozzle plate. In particular, when it is attempted to wipe off these inks adhered to the nozzle plate by using a wiping member, an ink-proof film made of fluorocarbon resin that is coating on the surface of the ink plate in order to suppress the adhering of the inks to the nozzle plate will be worn. This is presumably caused as the inorganic pigments or metal oxides contained in the inks will function similarly as abrasives.

SUMMARY OF THE INVENTION

It is an object of the present invention to provide a cleaning liquid to be used in cleaning inks adhered to a nozzle plate, and a nozzle plate cleaning method using this cleaning liquid.

The first feature according to the embodiments of the present invention is that, in the cleaning liquid, carbonates are added to the weakly alkali solution of pH 8 to pH 12.

The second feature according to the embodiments of the present invention is that the nozzle plate cleaning method has cleaning a nozzle plate adhered with inks in which at least one of inorganic pigments and metal oxides is mixed into polymers, by using a polymer dissolving solution, and cleaning the nozzle plate by using a weakly alkali cleaning liquid of pH 8 to pH 12, after a cleaning by using the polymer dissolving solution is carried out.

DETAILED DESCRIPTION OF THE INVENTION

In the following, one embodiment of the present invention will be described with references to the drawings.

Figure 1:
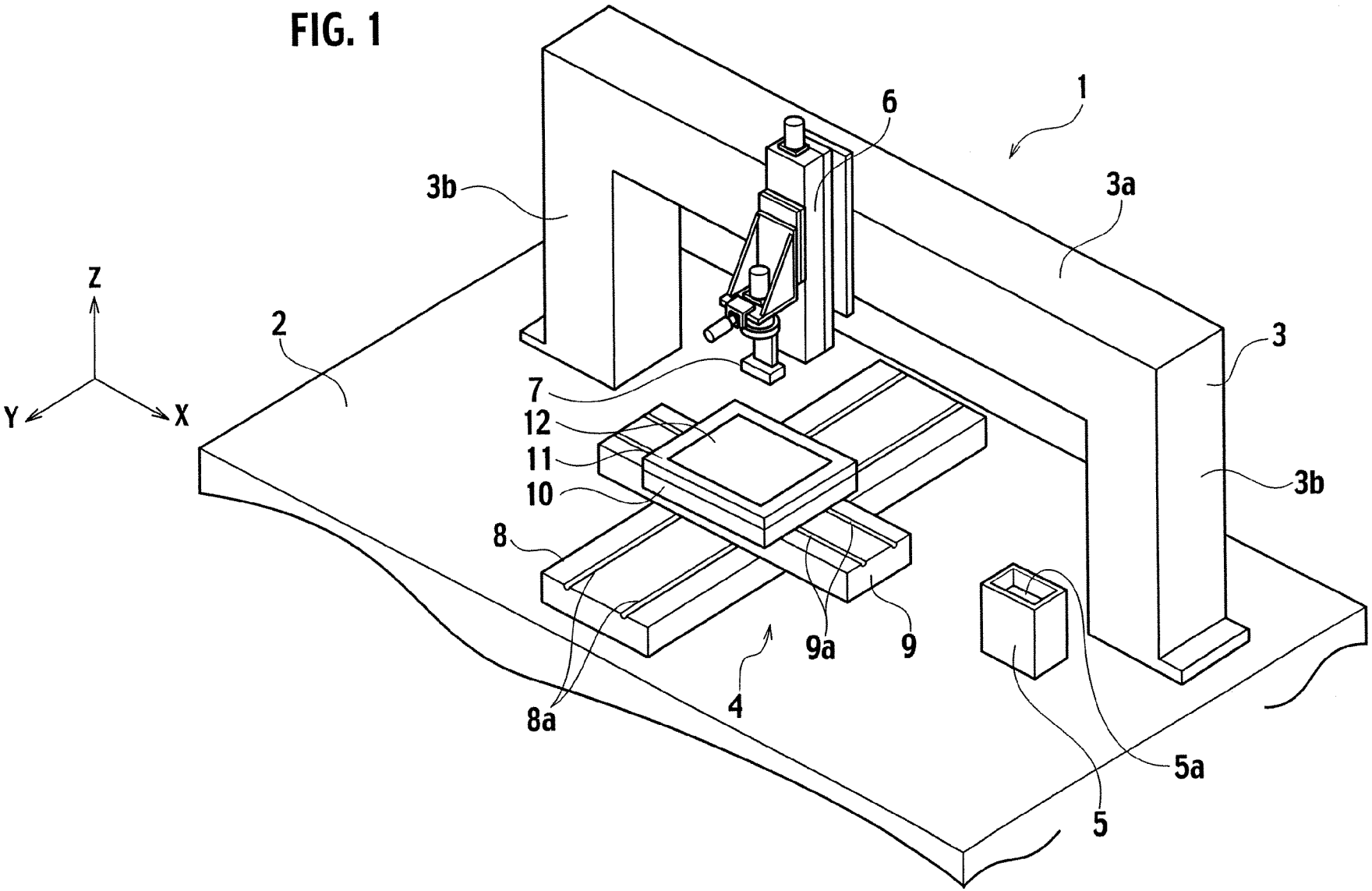
FIG. 1 is a perspective view showing a schematic configuration of an ink jet printer of one embodiment of the present invention.

An ink jet printer 1 shown in FIG. 1 is an ink jet printer for industrial use which uses inks in which at least one of inorganic pigments and metal oxides is mixed into polymers, and which has a base 2, a support body 3, a moving mechanism 4, and a cleaning unit 5. The supporting body 3, the moving mechanism 4 and the cleaning unit 5 are arranged on the base 2.

The support body 3 is formed in a gate shape having a horizontal axis 3*a* and a pair of leg portions 3*b* provided at both ends of the horizontal axis 3*a*, and arranged at a position straddling across the moving mechanism 4. To the support body 3, a movable member 6 is attached, and an ink jet head 7 is attached to this movable member 6. The movable member 6 is attached to be capable of ascending/descending in the Z-axis direction (vertical direction) and capable of moving in the X-axis direction (horizontal direction) along the horizontal axis 3*a* of the support body 3.

The moving mechanism 4 has a Y-axis direction guiding plate 8, a Y-axis direction moving table 9, an X-axis direction moving table 10, and a substrate holding table 11.

The Y-axis direction guiding plate 8 is fixed on an upper face of the base 2. On an upper face of the Y-axis direction guiding plate 8, a guiding groove 8*a* extending in the Y-axis direction is formed.

The Y-axis direction moving table 9 is arranged on the Y-axis direction guiding plate 8, and on a lower face of the Y-axis direction moving table 9, a protruded portion (not shown) to be slidably engaged with the guiding groove 8*a* is formed. The Y-axis direction moving table 9 is made to be capable of sliding in the Y-axis direction along the guiding groove 8*a*, by a feed mechanism (not shown) using a feed screw and a driving motor. On an upper face of the Y-axis direction moving table 9, a guiding groove 9*a* extending in the X-axis direction is formed.

The X-axis direction moving table 10 is arranged on the Y-axis direction moving table 9, and on a lower face of the X-axis direction moving table 10, a protruded portion (not shown) to be slidably engaged with the guiding groove 9*a* is formed. The X-axis direction moving table 10 is made to be capable of sliding in the X-axis direction along the guiding groove 9*a*, by a feed mechanism (not shown) using a feed screw and a driving motor.

The substrate holding table 11 is fixed on an upper face of the X-axis direction moving table 10. On an upper face of the substrate holding table 11, a substrate 12 to be coated with inks is mounted to be capable of being loaded/unloaded. The substrate 12 mounted on an upper face of the substrate holding table 11 is adsorbed by an adsorption mechanism (not shown) provided on the substrate holding table 11, and held at a fixed position. Note that the substrate holding table 11 is made to be capable of moving in the Y-axis direction on the Y-axis direction guiding plate 8, along with the X-axis direction moving table 10 and the Y-axis direction moving table 9. The substrate holding table 11 moving in the Y-axis direction is made to be capable of moving to a position at which the substrate 12 mounted on the substrate holding table 11 is located below the ink jet head 7 and the coating of the ink drops can be carried out (a position shown in FIG. 1), and a position at which the substrate holding table 11 is off a position below the ink jet head 7 and the loading/unloading of the substrate 12 on the substrate holding table 11 can be carried out.

The cleaning unit 5 is a portion for cleaning the nozzle plate to be described below which constitutes a part of the ink jet head 7. The cleaning unit 5 has a cleaning tank 5*a* into which a cleaning liquid is poured, a mechanism (not shown) for pouring the cleaning liquid into or out of the cleaning tank 5*a*, and an ultrasonic vibrator device (not shown) for applying ultrasonic vibrations with respect to the cleaning liquid in the cleaning tank 5*a*.

Figure 2:
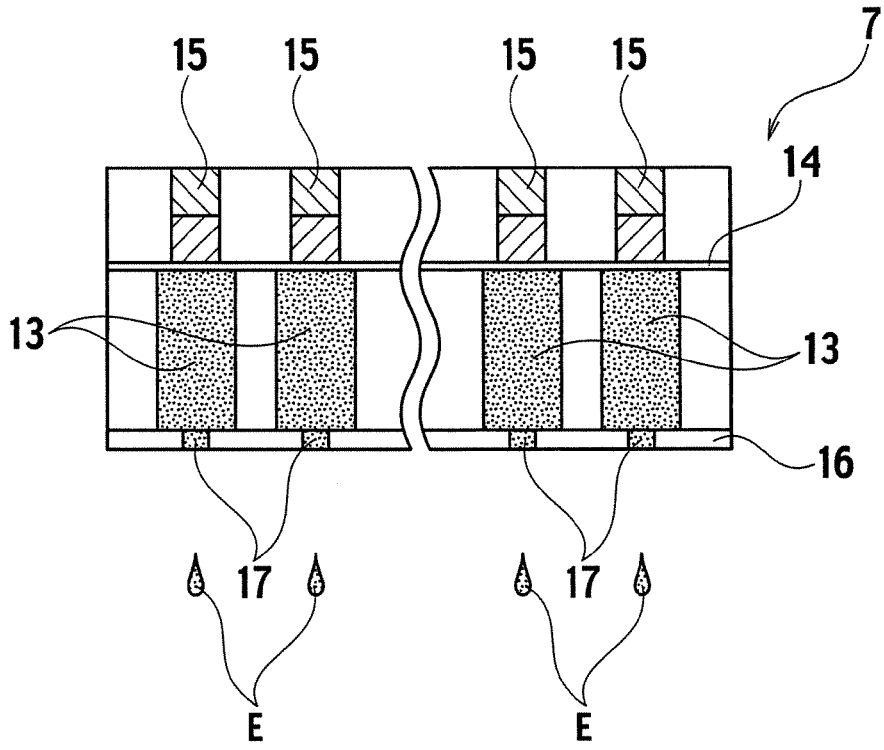
FIG. 2 is a cross sectional view showing an ink jet head provided in the ink jet printer shown in FIG. 1.

As shown in FIG. 2, the ink jet head 7 has a plurality of ink chambers 13, a diaphragm 14, a plurality of piezoelectric elements 15, and a nozzle plate 16. To the ink chambers 13, the inks in which at least one of inorganic pigments and metal oxides is mixed into polymers are supplied from ink tanks (not shown). The diaphragm 14 constitutes a part of a wall of each ink chamber 13. A plurality of piezoelectric elements 15 are provided at positions to make contact with the diaphragm 14 in correspondence to the respective ink chambers 13. The nozzle plate 16 constitutes a part of a wall of each ink chamber 13. On the nozzle plate 16, a plurality of nozzles 17 connected to the respective ink chambers 13 are formed.

At the ink jet head 7, as voltages are applied to the piezoelectric elements 15, the piezoelectric elements 15 are deformed in contracting direction, and the diaphragm 14 is bent in a direction for enlarging the volumes of the ink chambers 13 due to this deformation. The inks will be poured into the ink chambers 13 with the enlarged volumes such that the amounts of inks accommodated in the ink chambers 13 will be increased. After that, as the application of voltages is interrupted, the contracted piezoelectric elements 15 are recovered and the volumes of the ink chambers 13 are recovered while a part of inks in the ink chambers 13 are injected as ink drops E from the nozzles 17. The ink drops E injected from the nozzles 17 are coated onto a target position on the substrate 12.

As the injection of the ink drops E from the nozzles 17 is repeated, the inks will be adhered to portions surrounding the nozzles 17 on the surface of the nozzle plate 16. The cleaning of the inks adhered to the surface of the nozzle plate 16 is carried out at the cleaning unit 5. In the case of cleaning the ink jet head 7 at the cleaning unit 5, the ink jet head 7 is moved above the cleaning unit 5 along the horizontal axis 3*a* of the support body 3 along with the movable member 6. Then, the ink jet head 7 is lowered to be positioned inside the cleaning tank 5*a*, and the cleaning by the polymer dissolving solution and the cleaning by the weakly alkali solution are carried out in the cleaning tank 5*a* in two stages.

Note that this cleaning operation may be carried out automatically according to a program, or may be carried out by switch operations by an operator. In the case of carrying it out according to a program, it may be carried out after one day's work is finished, or it may be carried out according to a detection result of a sensor for detecting a stained state of the nozzle plate 16, for example.

Figure 3:
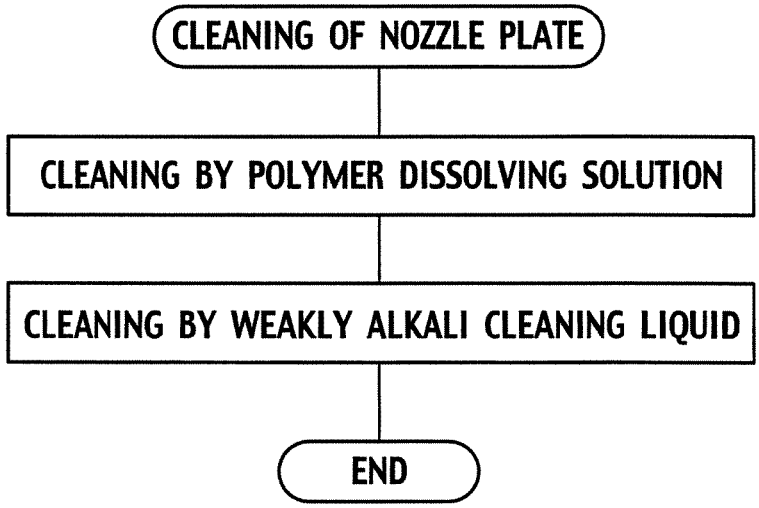
FIG. 3 is a flow chart showing a nozzle plate cleaning procedure.

FIG. 3 shows a procedure of an operation for cleaning the nozzle plate 16. The operation for cleaning the nozzle plate 16 is carried out in two stages, and the cleaning by the polymer dissolving solution is carried out first. For the polymer dissolving solution, a solution in which PGMEA (Polyethylene Glycol Monomethyl Ether Acetate) and CHN (Cyclohexane) are mixed can be used. The mixing ratio of PGMEA and CHN can be set as 1:1 weight ratio, for example. CHN has a function for dissolving the polymers that constitute the inks, and PGMEA has a function for penetrating into gaps between the polymers. The polymer dissolving solution in which PGMEA and CHN are mixed is poured into the cleaning tank 5*a*, the nozzle plate 16 of the ink jet head 7 is dipped into this polymer dissolving solution, and the ultrasonic cleaning is carried out a preset period of time (three minutes, for example).

By carrying out the cleaning by the polymer dissolving solution (ultrasonic cleaning), the polymers that constitute the inks are dissolved, and the surface of the nozzle plate 16 is set in a state in which inorganic pigments and metal oxides that constitute the inks are remaining thereon.

Next, the polymer dissolving solution is drained from the cleaning tank 5*a*, and the weakly alkali cleaning liquid of pH 8 to pH 12 is poured into the cleaning tank 5*a*, and the ultrasonic cleaning is carried out for a preset period of time (three minutes, for example). By carrying out this cleaning using the weakly alkali cleaning liquid (ultrasonic cleaning), the inorganic pigments, the metal oxides and the other dusts remaining on the nozzle plate 16 are removed. The weakly alkali cleaning liquid can remove the inorganic pigments and the metal oxides without damaging the ink-proof film made of fluorocarbon resin that is coating the surface of the nozzle plate 16.

By carrying out the cleaning of the nozzle plate 16 with adhered inks in two stages of the cleaning by the polymer dissolving solution and the cleaning by the weakly alkali cleaning liquid, the inks formed by mixing the inorganic pigments and the metal oxides into the polymers which has a good adhesiveness with respect to glasses and resins can be removed surely from the nozzle plate 16. In addition, the inks can be removed without damaging the ink-proof film made of fluorocarbon resin that is coating the surface of the nozzle plate 16.

The weakly alkali cleaning liquid to be used in the second stage of the cleaning operation is formed by adding 5 ppm to 1% of carbonates to the weakly alkali solution of pH 8 to pH 12. For example, it is formed by adding 200 ppm of TMAH (Tri Methyl Ammonium Hydride) carbonates to TMAH solution of pH 11. The weakly alkali solution is prone to have its pH value lowered by absorbing the carbon dioxide in the air. However, by adding the carbonates, it becomes harder for the pH value to vary due to the buffer effect, so that it becomes possible to maintain the pH value suitable for the cleaning liquid.

Consequently, by using the cleaning liquid to which the carbonates are added as the weakly alkali cleaning liquid, the pH value of this cleaning liquid can be maintained in a state of being weakly alkali over a long period of time. As a result, it becomes possible to prevent the pH value of the weakly alkali cleaning liquid from changing towards the neutral side in conjunction with the elapse of time, and it becomes possible to maintain the cleaning performance of this cleaning liquid over a long period of time. Note that the amount of carbonates to be added can be changed depending on a period of time for which the weakly alkali pH value of the cleaning liquid is desired to be maintained, such that the amount of carbonates are increased more when the period of time for which the pH value is desired to be maintained becomes longer.

Figure 4:
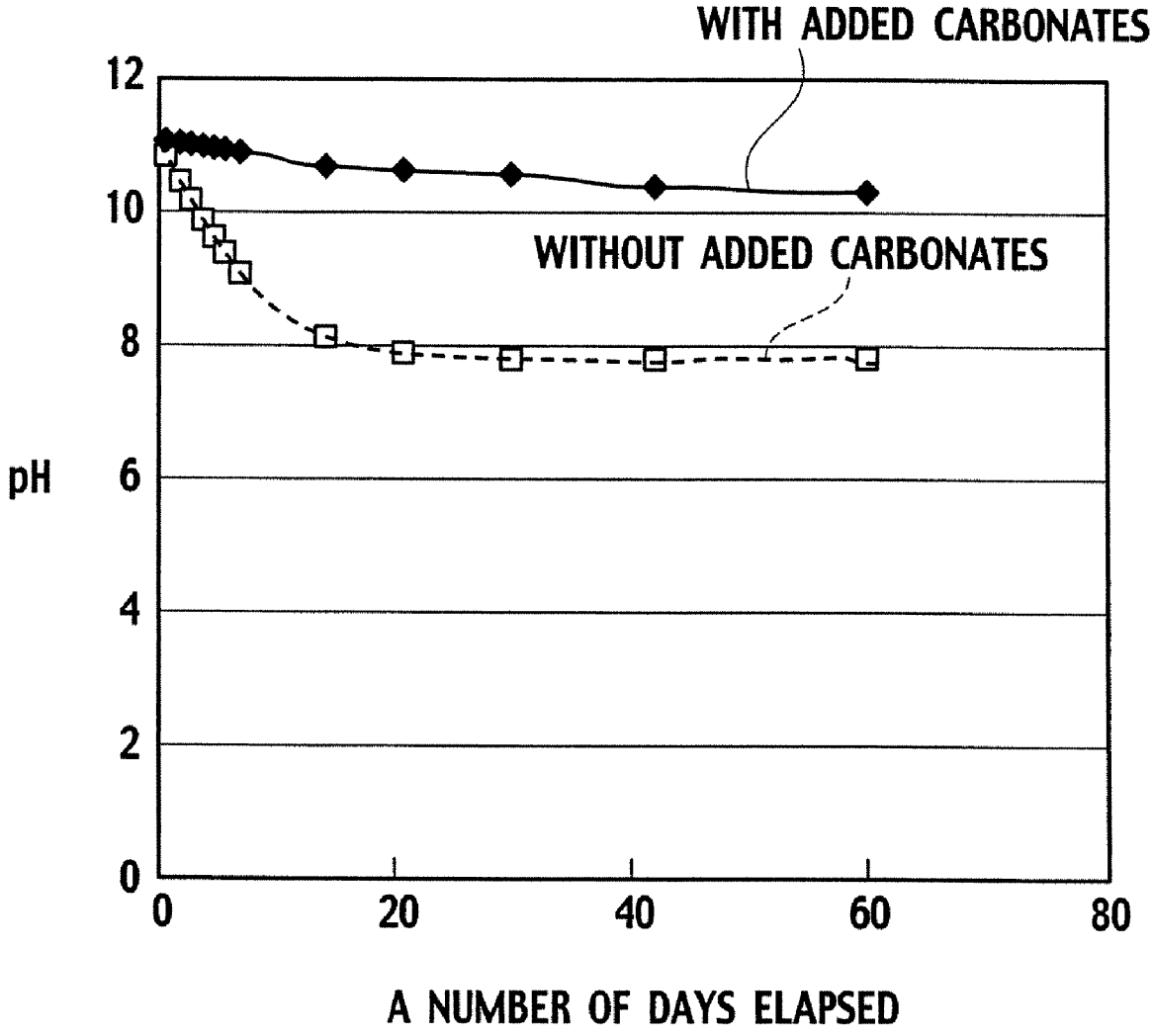
FIG. 4 is a graph showing a measurement result of the pH value change in time for the weakly alkali cleaning liquid with added carbonates and the weakly alkali cleaning liquid without added carbonates.

FIG. 4 is a graph showing a result of measuring the variation of the pH value for the weakly alkali cleaning liquid of pH 11 with added carbonates, and for the weakly alkali cleaning liquid of pH 11 without added carbonates. In the case of not adding the carbonates, it is demonstrated that the pH value becomes below 8 and the function of the cleaning liquid is lost after about 20 days since the measurement is started. In contrast, in the case of adding the carbonates, it is demonstrated that the pH value is maintained above 8 and the function of the cleaning liquid is retained even after 60 days elapsed since the measurement is started.

As a result, by using the weakly alkali cleaning liquid with added carbonates in the cleaning of the nozzle plate 16, it becomes possible to extend the period of time for which the weakly alkali cleaning liquid can function as the cleaning liquid. Then, it is possible to prevent an occurrence of a situation in which the cleaning of the nozzle plate 16 becomes insufficient as the pH value of the weakly alkali cleaning liquid is lowered by the change in time.

Note that this embodiment is directed to an exemplary case of using the weakly alkali cleaning liquid with added carbonates for the purpose of cleaning of the nozzle plate 16, but the use of this cleaning liquid is not limited to the cleaning of the nozzle plate 16.

What is claimed is:

1. A nozzle plate cleaning method, comprising:

a) cleaning a nozzle plate adhered with an ink by using a polymer dissolving solution, said ink comprising at least one member selected from the group consisting of an inorganic pigment, a metal oxide, and a combination thereof, said member being mixed into a polymer; and b) cleaning the nozzle plate by using a weakly alkali cleaning liquid of pH 8 to pH 12, after the cleaning in step a), wherein said polymer dissolving solution comprises polyethylene glycol monomethyl ether acetate and cyclohexane.

2. The nozzle plate cleaning method of claim 1, wherein a carbonate is added to the weakly alkali cleaning liquid.

3. The nozzle plate cleaning method of claim 1, wherein after said step a), by using the polymer dissolving solution, the polymer of the ink is dissolved, and the inorganic pigment and/or metal oxide remain on a surface of the nozzle plate.

4. The nozzle plate cleaning method of claim 1, wherein said step a) is performed as ultrasonic cleaning.

5. The nozzle plate cleaning method of claim 1, wherein said step b) is performed as ultrasonic cleaning.

6. The nozzle plate cleaning method of claim 1, wherein said inorganic pigment and/or said metal oxide are removed in step b) from said nozzle plate.

7. The nozzle plate cleaning method of claim 1, wherein said weakly alkali cleaning liquid removes the inorganic pigment and/or the metal oxide without damaging an ink-proof film which comprises a fluorocarbon resin, said ink-proof film being coated on a surface of the nozzle plate.

8. The nozzle plate cleaning method of claim 1, wherein said weakly alkali cleaning liquid to be used in step b) is formed by adding between 5 ppm to 1% of a carbonate to the weakly alkali solution of pH 8 to pH 12.

9. The nozzle plate cleaning method of claim 8, wherein said carbonate is tri-methyl ammonium hydride carbonate.

10. The nozzle plate cleaning method of claim 1, wherein the pH value of the weakly alkali cleaning liquid is maintained for 60 days.

* * * * *

UNITED STATES PATENT AND TRADEMARK OFFICE

CERTIFICATE OF CORRECTION

PATENT NO. : 7,632,359 B2
APPLICATION NO. : 11/856364
DATED : December 15, 2009
INVENTOR(S) : Sakurai et al.

It is certified that error appears in the above-identified patent and that said Letters Patent is hereby corrected as shown below:

On the title page, Item (73), the Assignee's information is incorrect. Item (73) should read:

-- (73) Assignee: Kabushiki Kaisha Toshiba, Tokyo (JP) --

Signed and Sealed this

Ninth Day of February, 2010

David J. Kappos

David J. Kappos
*Director of the United States Patent and Trademark Office*